US008857975B2

(12) United States Patent
Moriya et al.

(10) Patent No.: US 8,857,975 B2
(45) Date of Patent: Oct. 14, 2014

(54) INK JET PRINTING APPARATUS

(75) Inventors: Yuki Moriya, Shiojiri (JP); Kenji Yanagishita, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 40 days.

(21) Appl. No.: 13/601,974

(22) Filed: Aug. 31, 2012

(65) Prior Publication Data

US 2013/0057632 A1 Mar. 7, 2013

(30) Foreign Application Priority Data

Sep. 2, 2011 (JP) ..... 2011-191915
Jul. 4, 2012 (JP) ..... 2012-150683

(51) Int. Cl.

| | |
|---|---|
| ***B41J 2/01*** | (2006.01) |
| ***B41J 3/407*** | (2006.01) |
| ***B41J 11/06*** | (2006.01) |
| ***B41J 11/00*** | (2006.01) |

(52) U.S. Cl.

CPC ..... *B41J 3/4078* (2013.01); *B41J 11/06* (2013.01); *B41J 11/0085* (2013.01)
USPC ..... 347/104; 347/101

(58) Field of Classification Search
None
See application file for complete search history.

(56) References Cited

U.S. PATENT DOCUMENTS

| | | | | |
|---|---|---|---|---|
| 7,237,890 | B2 | 7/2007 | Niimi et al. | |
| 7,413,301 | B2 | 8/2008 | Niimi et al. | |
| 7,765,927 | B1 | 8/2010 | Liu et al. | |
| 8,256,889 | B1 * | 9/2012 | Abbott et al. | 347/104 |
| 2007/0242242 | A1 * | 10/2007 | Nagasaka et al. | 355/53 |

FOREIGN PATENT DOCUMENTS

| | | |
|---|---|---|
| JP | 2001-096729 | 4/2001 |
| JP | 2004-276319 | 10/2004 |

* cited by examiner

*Primary Examiner* — Geoffrey Mruk
(74) *Attorney, Agent, or Firm* — Workman Nydegger

(57) ABSTRACT

An ink jet printing apparatus includes a placement table on which recesses in which swelling portions of a printing target material fall are formed and the printing target material is placed, and an ink jet head that discharges ink onto a surface of the printing target material of a printing side placed on the placement table so as to execute desired printing. The swelling portions such as seams fall in the recesses on the printing target material so that the swelling portions and the ink jet head can be avoided from rubbing with each other.

6 Claims, 12 Drawing Sheets

INK JET PRINTING APPARATUS

BACKGROUND

1. Technical Field

The present invention relates to an ink jet printing apparatus including a printing head which discharges ink onto a printing side of a surface of a printing target material to be transported so as to execute desired printing.

2. Related Art

In an apparel (clothing) manufacturer and a textile (fabric) manufacturer, existing "printing" in which a pattern and the like are printed on a surface of a fabric has been widely performed.

Further, as a printing apparatus which performs printing, an ink jet printing apparatus which makes ink which has been discharged from a printing head adhere directly onto a printing target material so as to execute printing has been developed.

As a technical problem specific to the ink jet printing apparatus of this type, there arises a problem due to swelling of a surface of a printing target material (for example, woven fabric) on a printing side. For example, swelling portions (raised portions) such as a stitched portion, a zipper, and a pocket are present on a cloth. Therefore, there is a risk that a head surface of an ink jet printing head makes contact with the swelling portions at the time of printing and a printing result is adversely affected. In contrast, if the ink jet printing head is made farther from the printing target material in order to solve the above-described problem, there arises a risk that image quality is lowered due to this distancing.

On the other hand, a technique for overcoming difficulties that a seam and a folding portion being present on a needlework generate differences in thickness when the needlework is placed on a flat surface is disclosed in JP-A-2001-96729. That is to say, a technique of sandwiching a mat board such as a foam sheet between a carrier (table on which the needlework is placed) and an image recording portion of the needlework and lifting the image recording portion so as to minimize the distance between the recording head and the image recording portion has been proposed.

With the technique as described in JP-A-2001-96729, contact between the seamed portion and the recording head can be avoided by lifting the image recording portion to be higher than the seamed portion with the mat board. However, since the image recording portion is lifted with the mat board, fluctuation in a thickness of the mat board leads to fluctuation in a distance between the recording head and the needlework as it is. Accordingly, a preferable recording result cannot be necessarily obtained in some cases.

SUMMARY

An advantage of some aspects of the invention is to provide an ink jet printing apparatus which can obtain a more appropriate printing result while avoiding contact between a swelling portion such as a seam and a printing head even if a printing target material having the swelling portion is used.

An ink jet printing apparatus according to a first aspect of the invention includes a placement table that includes a recess in which a swelling portion of a printing target material falls and on which the printing target material is placed, and a printing head that discharges ink onto a printing side of a surface of the printing target material placed on the placement table so as to execute desired printing.

With the aspect of the invention, in the ink jet printing apparatus, the placement table on which the printing target material is placed includes the recess in which the swelling portion of the printing target material falls. Accordingly, the swelling portion of the printing target material is made to fall in the recess so as to reduce a risk that the swelling portion and the printing head make contact with each other. Further, the printing target material is supported on the placement table on a region excluding the recess so as to ensure flatness of a surface of the printing target material at the printing side. That is to say, fluctuation in a distance between the surface at the printing side and the printing head can be prevented or a degree of the fluctuation in the distance therebetween can be reduced, thereby obtaining a preferable printing result.

According to a second aspect of the invention, it is preferable that a suction hole through which the printing target material is sucked be provided in the recess in the first aspect of the invention.

With the aspect of the invention, the swelling portion of the printing target material which has fallen in the recess is sucked through the suction hole so as to cause the swelling portion to fall in the recess more reliably. In particular, even when rigidity of the printing target material is high, the swelling portion can be made to fall in the recess more reliably.

According to a third aspect of the invention, it is preferable that strength of suction through the suction hole be capable of being adjusted in the second aspect of the invention.

With the aspect of the invention, the strength of the suction through the suction hole can be adjusted. Therefore, the degree of falling of the swelling portion in the recess can be adjusted. With this, the distance between the swelling portion and the printing head can be set more appropriately.

According to a fourth aspect of the invention, it is preferable that a degree of the suction through the suction hole be made relatively strong in a case where a printing target material having relatively high rigidity is used in comparison with a case where a printing target material having low rigidity is used, in accordance with rigidity of the printing target material, in the third aspect of the invention.

With the aspect of the invention, the degree of the suction through the suction hole is made relatively strong in the case where the printing target material having relatively high rigidity is used in comparison with the case where the printing target material having low rigidity is used, in accordance with the rigidity of the printing target material. With this, even when the printing target material has high rigidity, the swelling portion can be made to fall in the recess reliably, thereby obtaining an appropriate printing result more reliably.

According to a fifth aspect of the invention, in the third or fourth aspect of the invention, it is preferable that a degree of the suction through the suction hole be made relatively weak when ink is discharged at least onto the swelling portion in comparison with cases other than this ink discharging.

With the aspect of the invention, the degree of the suction through the suction hole is made relatively weak when ink is discharged at least onto the swelling portion in comparison with cases other than the ink discharging. With this, when ink is discharged onto the swelling portion, an adverse influence on ink landing accuracy due to suction can be prevented, or the adverse influence can be reduced.

According to a sixth aspect of the invention, in the first to fifth aspects of the invention, it is preferable that a holding member that holds the printing target material be provided on a periphery of the recess.

With the aspect of the invention, the holding member that holds the printing target material is provided on the periphery of the recess. With this, after the swelling portion has been made to fall in the recess, a problem that the periphery of the recess on the printing target material is pulled and the swelling portion floats can be prevented from occurring, or the degree of the floating can be reduced.

According to a seventh aspect of the invention, it is preferable that a depth of the recess be capable of being adjusted in the first to sixth aspects of the invention.

With the aspect of the invention, the depth of the recess is capable of being adjusted. Therefore, the depth of the recess can be adjusted to an appropriate depth in accordance with the degree of the swelling. With this, the distance between the swelling portion and the printing head can be set more appropriately.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention is described with reference to the drawings. The invention is not limited to embodiments, which will be described later, and various variations can be made within the range of the invention as described in the aspects of the invention. The embodiments of the invention are described below on an assumption that the various variations are also encompassed within the range of the invention.

Figure 1:
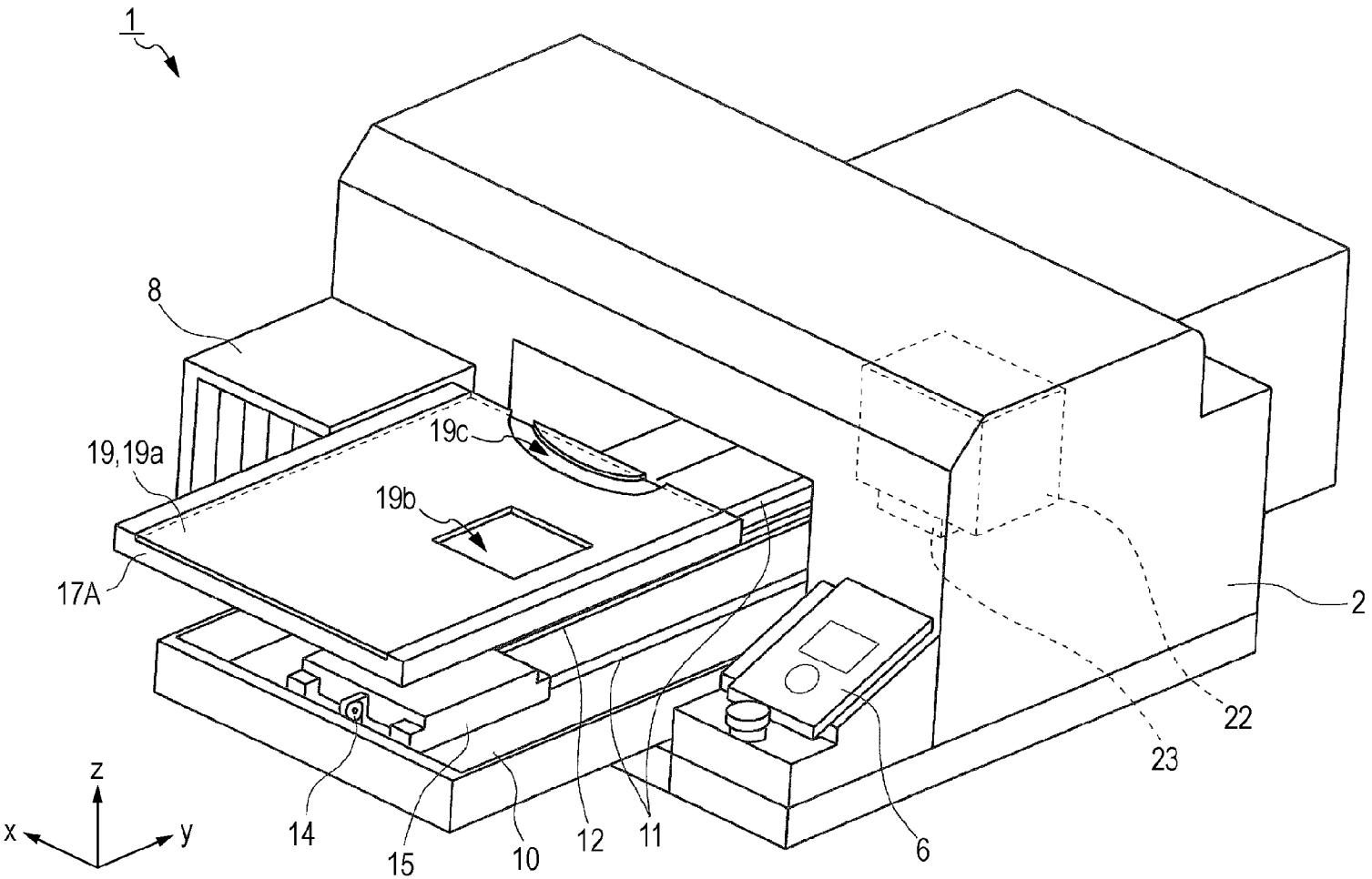
FIG. 1 is an external perspective view illustrating an ink jet printing apparatus according to the invention.
Figure 2:
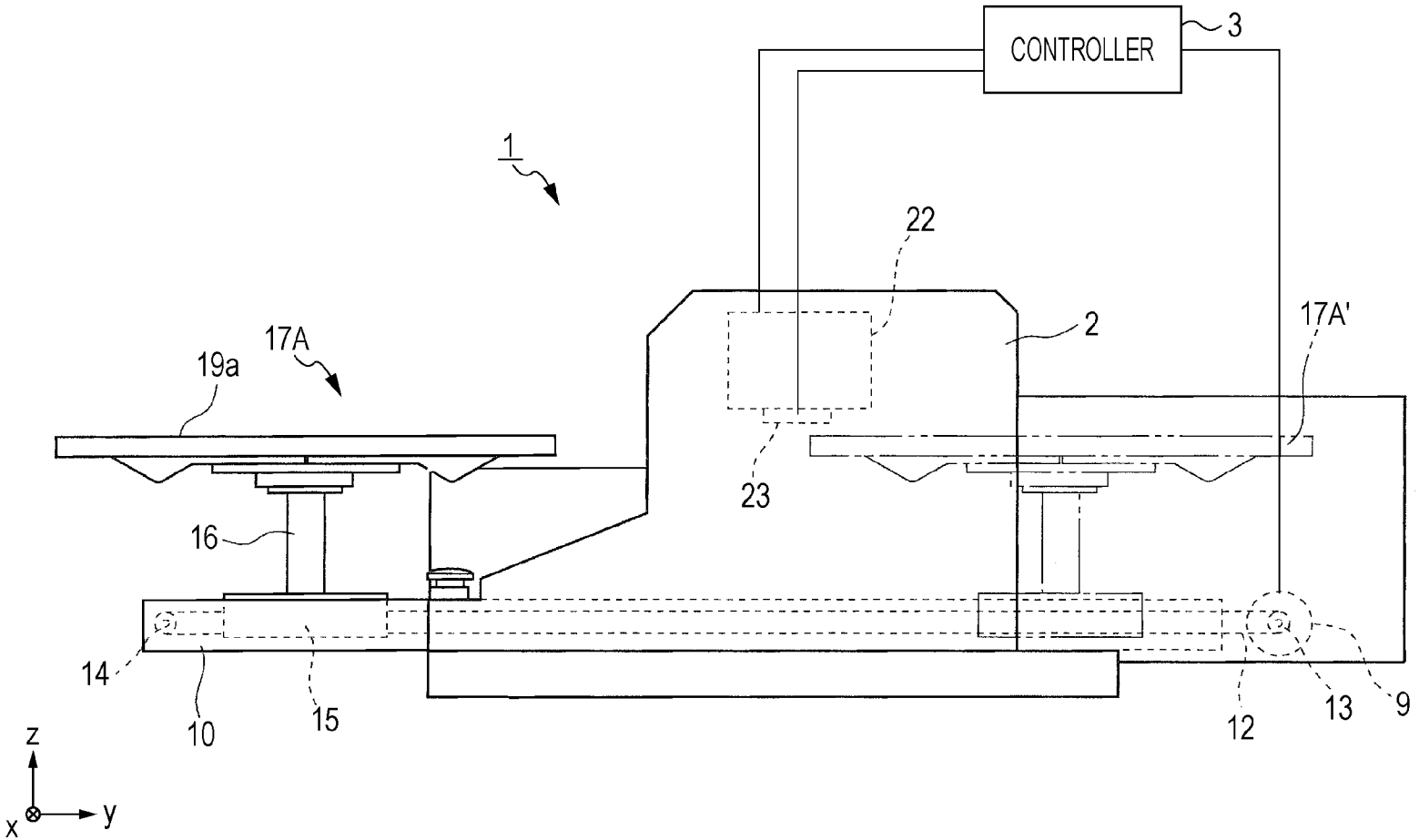
FIG. 2 is a side view illustrating the ink jet printing apparatus according to the invention.
Figure 3:
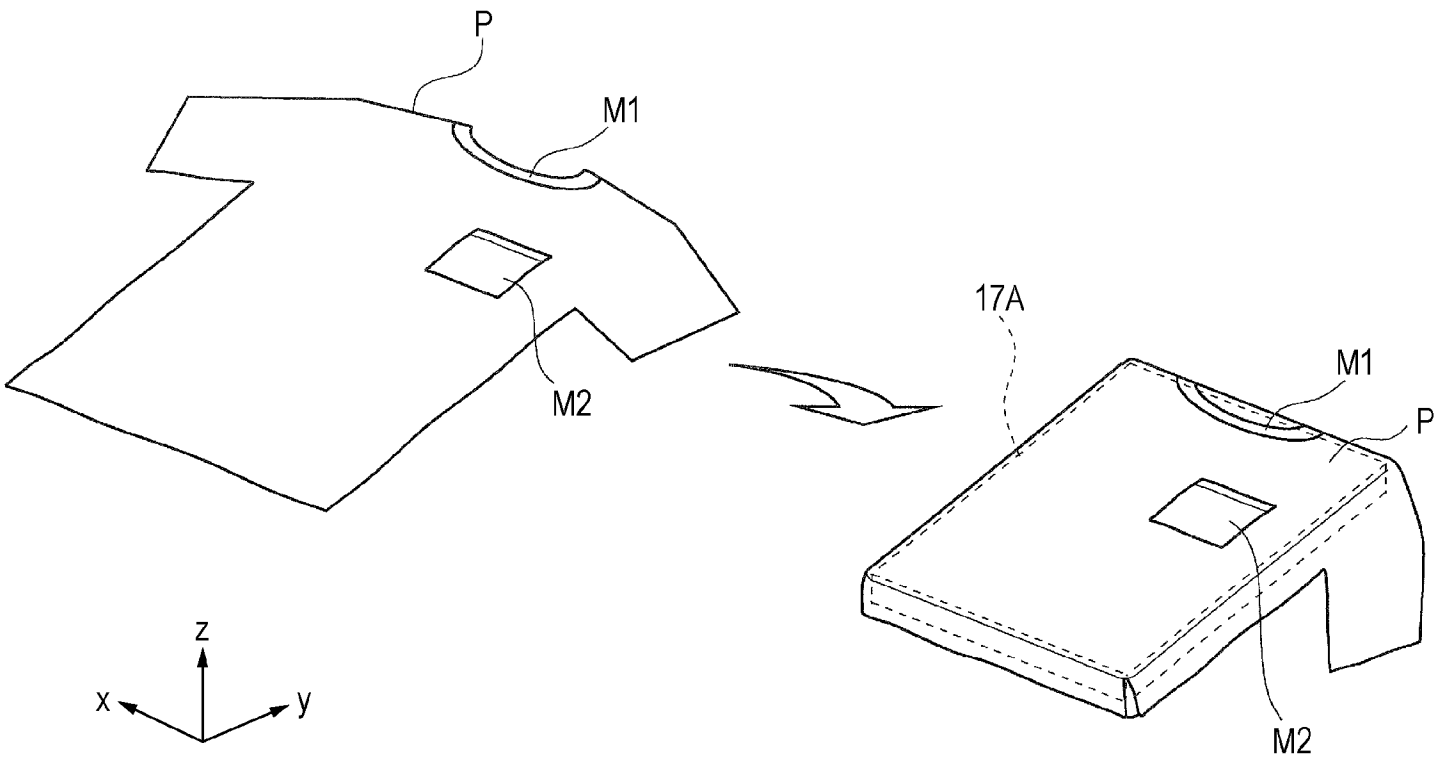
FIG. 3 is a perspective view illustrating a printing target material (first embodiment) and a state of the printing target material placed on a placement table.
Figure 4:
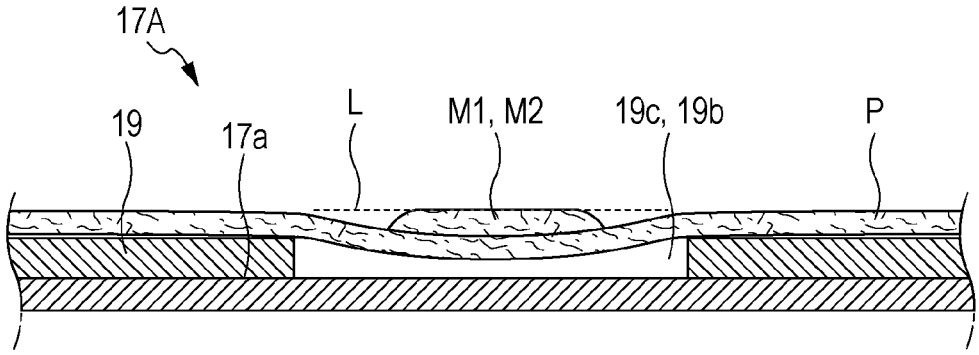
FIG. 4 is a cross-sectional view illustrating the placement table (first embodiment) and the printing target material.

FIG. 1 is an external perspective view illustrating an ink jet printing apparatus 1 according to an embodiment of the invention. FIG. 2 is a side view illustrating the ink jet printing apparatus 1. FIG. 3 is a perspective view illustrating a printing target material P and a state of the printing target material P placed on a placement table 17A. FIG. 4 is a cross-sectional view illustrating the placement table 17A according to the first embodiment and the printing target material P.

Figure 5:
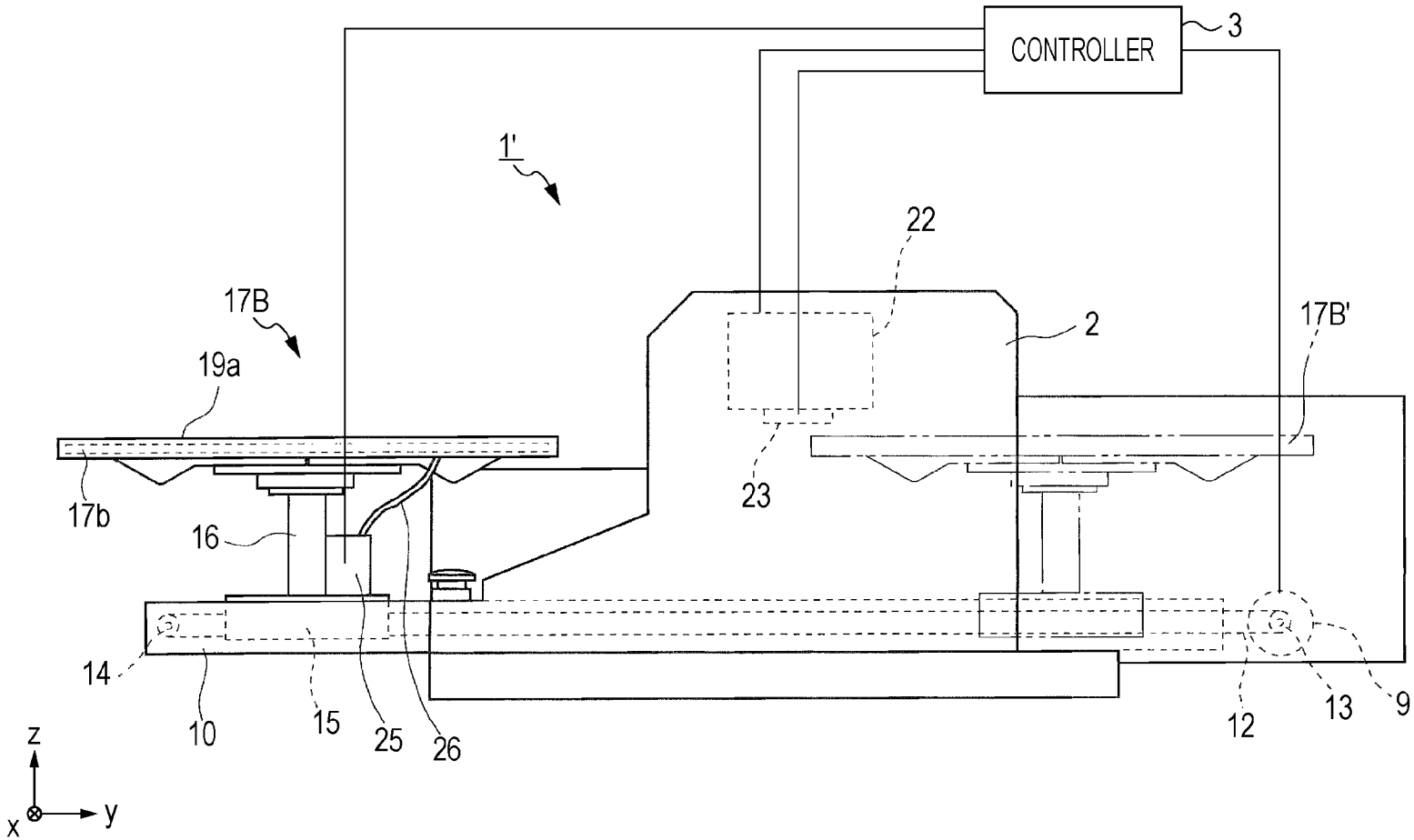
FIG. 5 is a side view illustrating an ink jet printing apparatus (second embodiment) according to the invention.
Figure 6B:
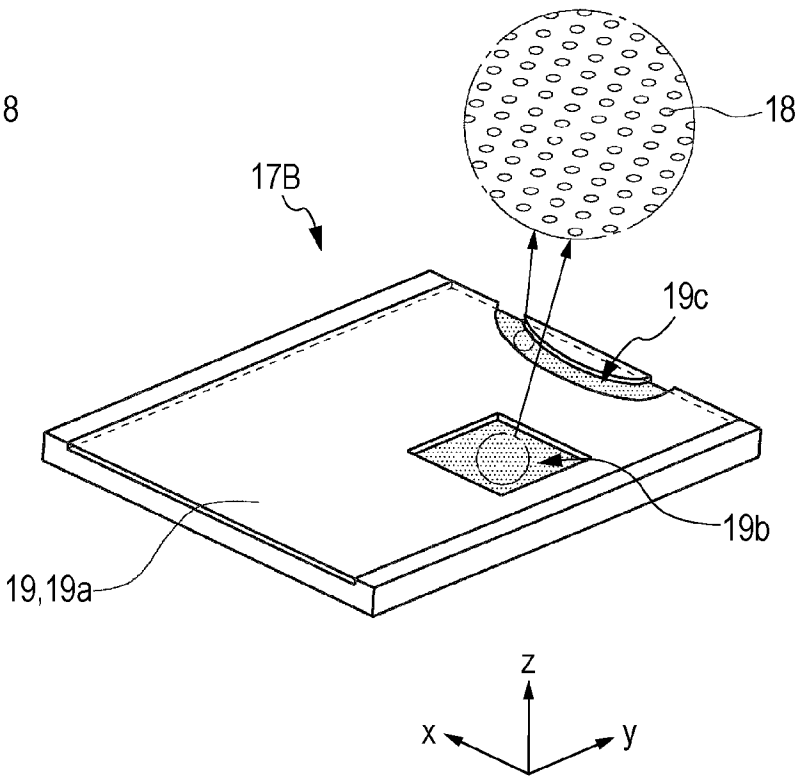
FIG. 6A is a perspective view illustrating a state before a placement plate is placed on a placement table (second embodiment) and FIG. 6B is a perspective view illustrating a state after the placement plate has been placed on the placement table (second embodiment).
Figure 6A:
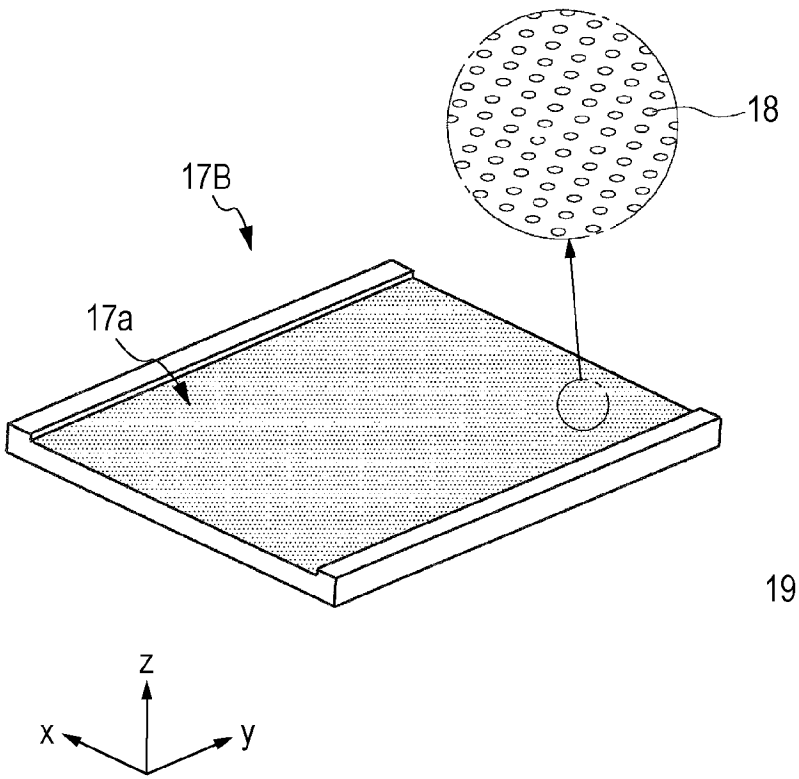
Figure 7A:
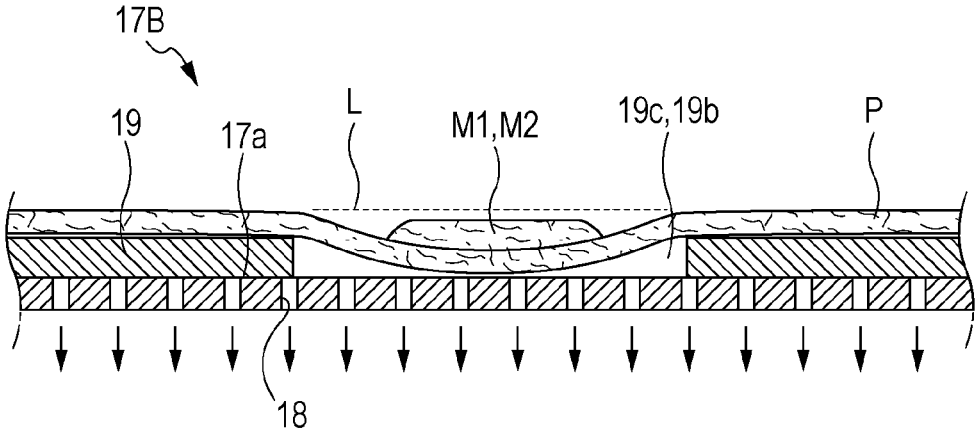
FIGS. 7A and 7B are cross-sectional views illustrating the placement table (second embodiment) and a printing target material.
Figure 7B:
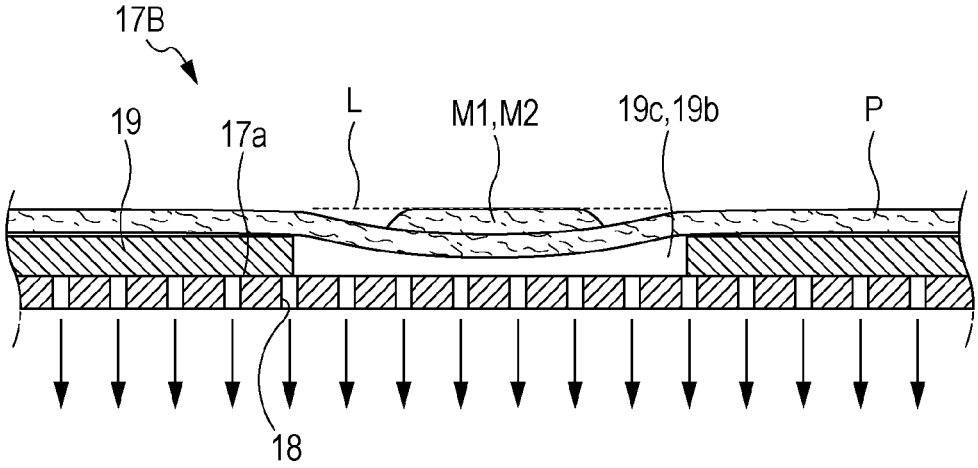
Figure 8:
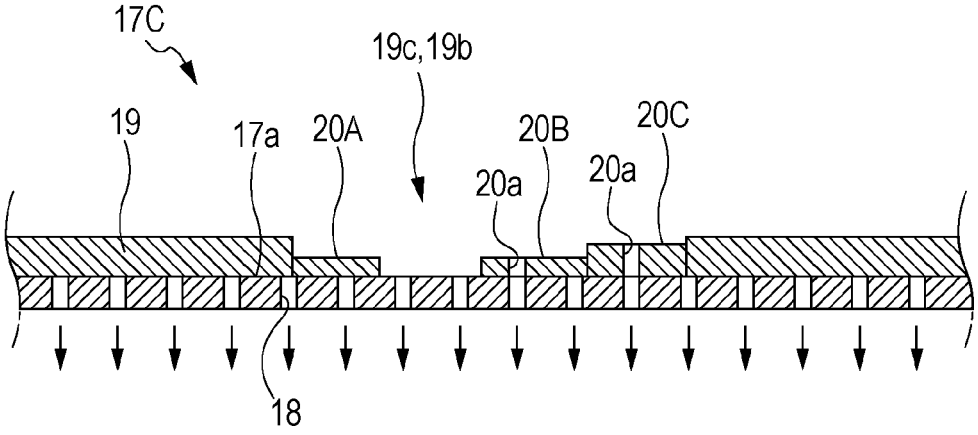
FIG. 8 is a cross-sectional view illustrating a placement table (third embodiment).
Figure 9:
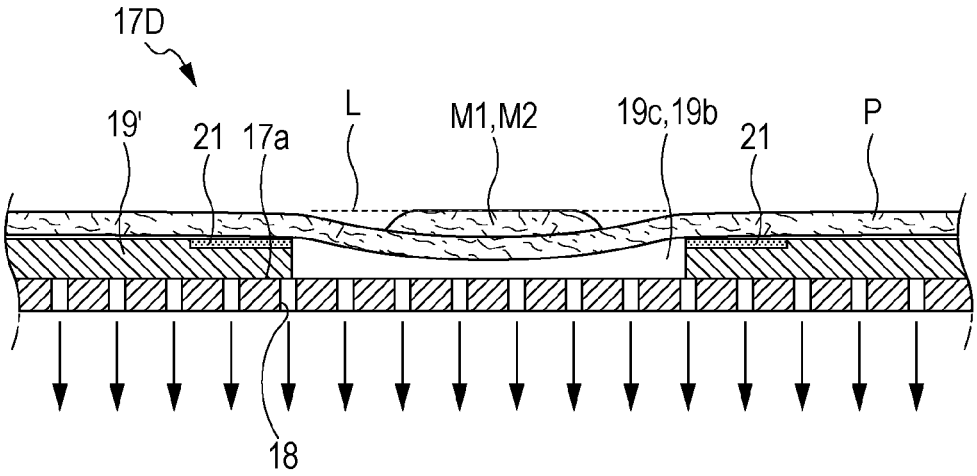
FIG. 9 is a cross-sectional view illustrating a placement table (fourth embodiment) and a printing target material.

Further, FIG. 5 is a side view illustrating an ink jet printing apparatus 1' according to a second embodiment. FIGS. 6A and 6B are perspective views illustrating a placement table 17B according to the second embodiment. FIGS. 7A and 7B are cross-sectional views illustrating the placement table 17B and the printing target material P. FIG. 8 is a cross-sectional view illustrating a placement table 17C according to a third embodiment. FIG. 9 is a cross-sectional view illustrating a placement table 17D according to a fourth embodiment.

Figure 10:
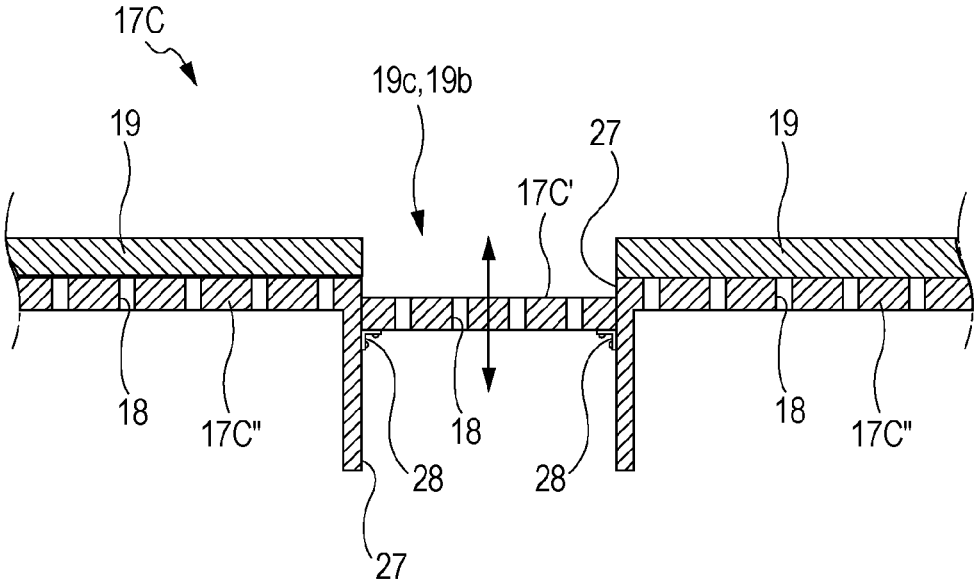
FIG. 10 is a cross-sectional view illustrating another example of a configuration of the placement table (third embodiment).
Figures 11A, 11B:
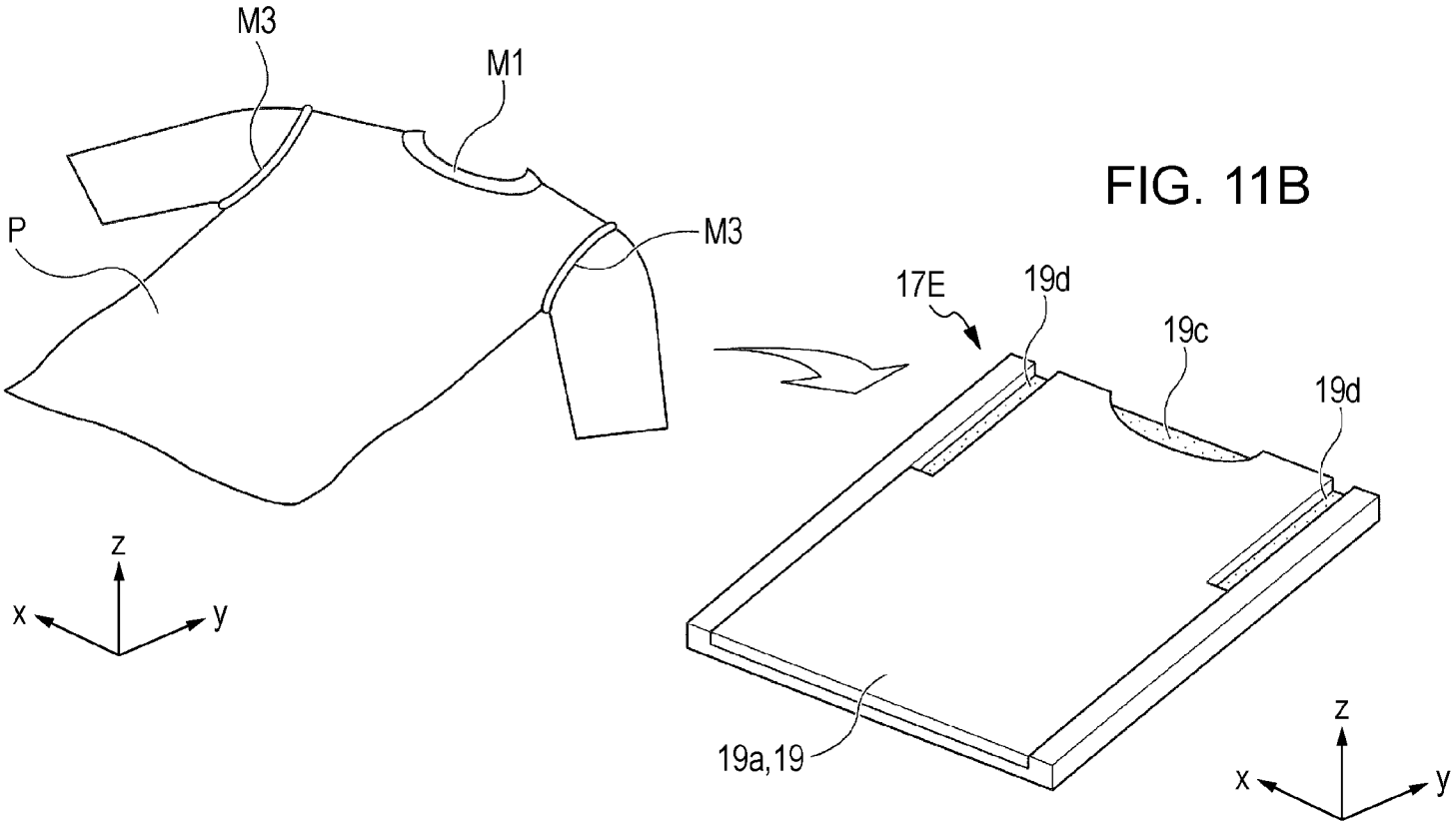
FIG. 11A is a perspective view illustrating a printing target material (fifth embodiment) and FIG. 11B is a perspective view illustrating a placement table which corresponds to the printing target material (fifth embodiment).
Figures 12A, 12B:
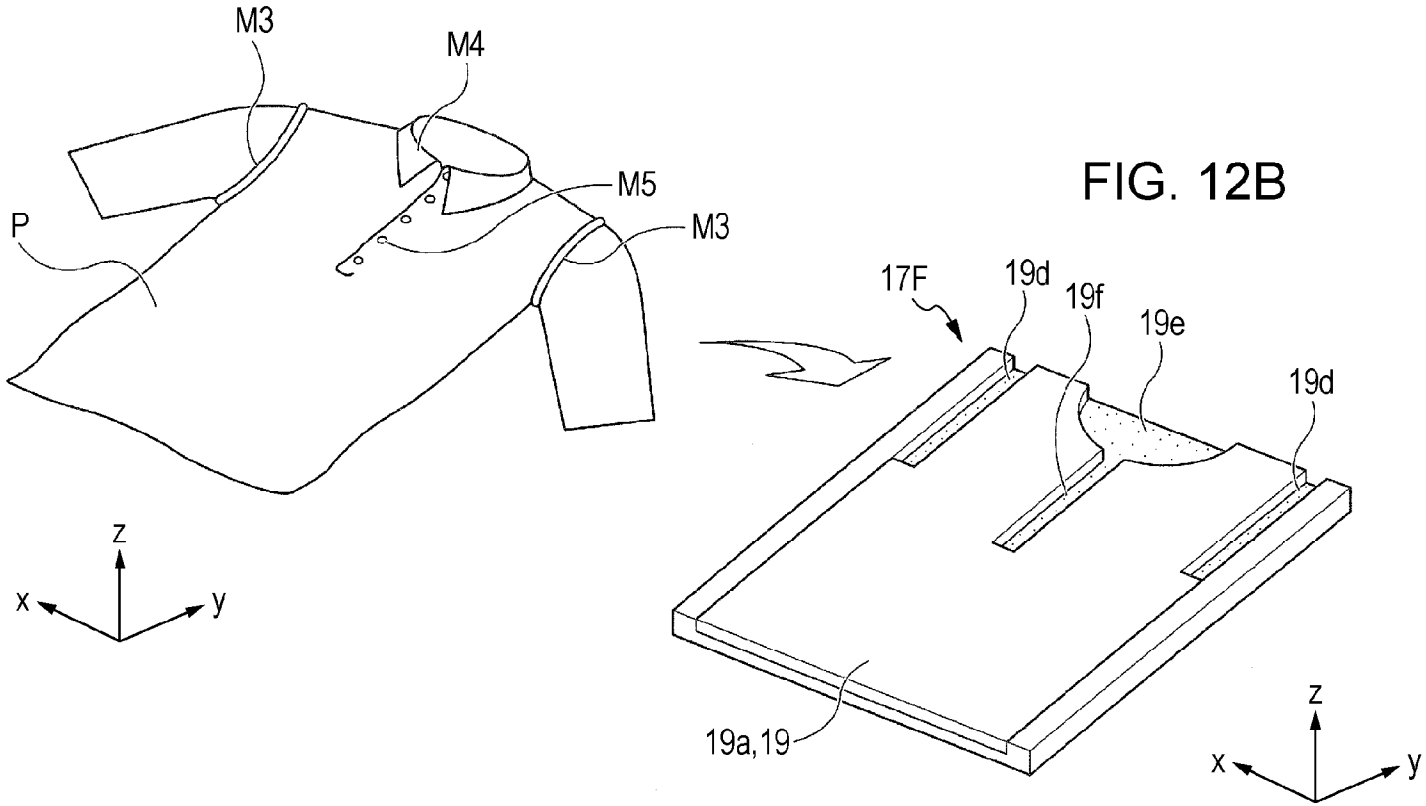
FIG. 12A is a perspective view illustrating a printing target material (sixth embodiment) and FIG. 12B is a perspective view illustrating a placement table which corresponds to the printing target material (sixth embodiment).

FIG. 10 is a cross-sectional view illustrating another example of a configuration of the placement table 17C according to the third embodiment. FIGS. 11A and 11B are perspective views illustrating a printing target material and a placement table 17E which corresponds to the printing target material according to a fifth embodiment. FIGS. 12A and 12B are perspective views illustrating a printing target material and a placement table 17F which corresponds to the printing target material according to a sixth embodiment.

It is to be noted that in the drawings, an x-y-z coordinate system indicates directions for the convenience of description. A z direction indicates a vertical (gravitational force) direction, a y direction indicates a transportation direction of the printing target material P (placement table movement direction), and an x direction indicates a direction perpendicular to the y direction and the z direction.

As illustrated in FIG. 1 and FIG. 2, the ink jet printing apparatus 1 includes a guide table 10 on a bottom portion of an apparatus main body 2 and is configured such that the placement table 17A is moved on the guide table 10. To be more specific, guide shafts 11 which are parallel with the y direction are arranged on the guide table 10. A base 15 is guided in the y direction by the guide shafts 11.

Further, an endless belt 12 is wound between a driving pulley 13 and a driven pulley 14 along the y direction. The base 15 is fixed to a part of the endless belt 12. The driving pulley 13 is driven rotationally by a tray driving motor 9 so as to rotate the endless belt 12. With this, the base 15 is moved in the y direction.

A shaft 16 is provided on the base 15 in a standing manner and the placement table 17A is attached onto the shaft 16. An upper surface of the placement table 17A corresponds to a placement surface 19*a* on which the printing target material P is placed. The printing target material P is placed on the placement surface 19*a* as illustrated in FIG. 3 (printing target material P in FIG. 3 indicates a T-shirt, as an example) and the placement table 17A on which the printing target material P has been placed is moved in the y direction. With this, the printing target material P can pass through a lower portion of an ink jet head 23 as a printing head.

Then, an operation panel 6 for performing various types of operations is arranged on an apparatus front surface of the ink jet printing apparatus 1 at a right side. An ink cartridge accommodating portion 8 in which an ink cartridge is accommodated is provided on the front surface of the apparatus 1 at an opposite side (apparatus left side) to the operation panel 6 sandwiching the placement table 17A therebetween.

Ink is supplied to the ink jet head 23 constituting a printing executing portion from the ink cartridge accommodated in the ink cartridge accommodating portion 8. The ink jet head 23 is an ink jet head having a well-known configuration and has a plurality of nozzle rows (not illustrated) on which a plurality of nozzle holes (not illustrated) for discharging ink are arranged. Further, the ink jet head 23 is mounted on a carriage 22 which is driven to reciprocate in the x direction (in FIG. 2, paper plane rear surface direction) intersecting with the transportation direction y.

The ink jet printing apparatus 1 has been described as an ink jet printing apparatus in which the ink jet head 23 is a serial-type head which discharges ink while moving in the x direction intersecting with the transportation direction y. However, the ink jet head 23 may be a line head. Further, it is needless to say that the line head may be provided in a fixed manner or provided to be movable in the transportation direction y.

The placement table 17A is transported to a position (printing start position) indicated by a virtual line and a reference numeral 17A'. Then, movement of the placement table 17A to the apparatus front side (left side in FIG. 2) and ink discharging from the ink jet head 23 are alternately performed so that printing is executed. If ink discharging onto the printing target material P has been finished, the placement table 17A returns to a position (set position of the printing target material P) indicated by a solid line in FIG. 2 so that the printing target material P onto which ink has been discharged can be taken out.

First Embodiment

Subsequently, the placement table 17A according to the first embodiment of the invention is described in detail. As illustrated in FIG. 1 and FIG. 4, the placement table 17A includes recesses 19*b* and 19*c* in which swelling portions (in FIG. 3, M1 and M2) of the printing target material P fall.

To be more specific, as illustrated in FIG. 3, the T-shirt as an example of the printing target material P is formed such that a neck portion M1 and a breast pocket portion M2 (examples) are thick. Therefore, if the T-shirt is placed on a flat surface only, the neck portion M1 and the breast pocket portion M2 are made into a state of being swelled to the upper side with respect to a surface (upper surface of the printing target material P) at the printing side. This arises a risk that the neck portion M1 and the breast pocket portion M2 will rub with the ink jet head 23.

Accordingly, the recess 19*c* having a shape corresponding to the neck portion M1 is formed on the placement table 17A at a position corresponding to the neck portion M1 (FIG. 1). Further, the recess 19*b* having a shape corresponding to the breast pocket portion M2 is formed at a position corresponding to the breast pocket portion M2 (FIG. 1). It is to be noted that the recess 19*c* is formed to be a region (area) which is slightly larger than the neck portion M1. In a similar manner, the recess 19*b* is formed to be a region (area) which is slightly larger than the breast pocket portion M2.

In FIG. 4, a dashed line L indicates a height of an upper surface (printing target surface) of the printing target material P. As illustrated in FIG. 4, since the recess 19*c* is formed on the placement table 17A, the neck portion M1 as an example of a swelling portion falls in the recess 19*c*. With this, the height of the neck portion M1 becomes the same height as other printing regions. Further, the breast pocket portion M2 can fall in the recess 19*b* in the same manner. Accordingly, rubbing with the head does not occur and a distance between the ink jet head 23 and the printing target material P needs not be made larger in order to prevent the rubbing with the head from occurring, thereby obtaining a preferable printing result.

It is to be noted that the recesses 19*b* and 19*c* are formed on a plate 19 which can be exchanged. The plate 19 can be set to an upper surface 17*a* (see FIG. 6A, too) of a main body of the placement table 17A. In a state where the plate 19 is set, the upper surface of the placement table 17A has the same height on the entire region other than the recesses 19*b* and 19*c*. Accordingly, when forms (positions, shapes, and sizes of the swelling portions) of the printing target material P are different, if the plates 19 corresponding to the forms are formed, the printing target material P of different forms can be easily available by exchanging to the plate 19 corresponding to the shape of the printing target material P.

Second Embodiment

Next, the second embodiment of the invention will be described. On the placement table 17B included by the ink jet printing apparatus 1' according to the second embodiment of the invention as illustrated in FIG. 5, suction holes for sucking the printing target material P are provided in recesses in which swelling portions of the printing target material P fall.

To be more specific, a hollow portion 17*b* is formed at the inner side of the placement table 17B as illustrated in FIG. 5. Further, a suction fan device 25 as a sucking unit arranged on the base 15 and the hollow portion 17*b* are connected to each other with a tube 26. A number of suction holes 18 (FIG. 6A) communicating with the hollow portion 17*b* are formed on the upper surface 17*a* of a main body of the placement table 17B. If the suction fan device 25 is operated, the printing target material P can be sucked through the suction holes 18. It is to be noted that strength of suction by the suction fan device 25 can be adjusted under control by a controller 3.

If the plate 19 is placed on the placement table 17B configured in the above manner, the suction holes 18 appear only on bottom portions of the recesses 19*b* and 19*c* as illustrated in FIG. 6B. Accordingly, if the printing target material P is placed on the above placement table 17B and the neck portion M1 and the breast pocket portion M2 as the swelling portions are made to fall in the recesses 19*c* and 19*b*, respectively, each swelling portion can be made to fall in each recess reliably. In particular, even when rigidity of the printing target material P is high, the swelling portions of the printing target material P can be made to fall in the recesses more reliably.

Further, the strength of the suction through the suction holes 18 can be adjusted. Therefore, the falling degree of a swelling portion of the printing target material P in the recess can be adjusted. For example, if the degree of the suction of the printing target material P having relatively high rigidity is set to be relatively stronger than that of the printing target material P having low rigidity, the neck portion M1 and the breast pocket portion M2 can be made to fall in the recesses 19*c* and 19*b*, respectively, reliably.

Further, since the strength of the suction through the suction holes 18 can be adjusted, when the swelling portions fall in the recesses more than necessary as illustrated in FIG. 7A, for example, and a desired printing result is not obtained, the following processing can be available. That is, the strength of the suction is adjusted so that height of the upper surface of the swelling portion can be made appropriate (can be adjusted to be uniform with that of the peripheral portion), as illustrated in FIG. 7B.

In addition, when ink is discharged onto the swelling portions of the printing target material P, it is preferable that the degree of the suction through the suction holes 18 be relatively weak in comparison with cases other than this ink discharging. That is to say, there is a risk that the suction through the suction holes 18 gives an adverse influence on ink landing accuracy. Therefore, the following processing can be available when ink is also discharged onto the swelling portion of the printing target material P. That is, if the suction is made relatively weak when ink is discharged onto the swelling portion, a preferable printing result of the swelling portion can be obtained.

A first characteristic of the second embodiment as described above is a point that the suction holes 18 are provided at the inner side of the recesses. A second characteristic thereof is a point that the strength of the suction through the suction holes 18 can be adjusted. A third characteristic thereof is a point that the strength of the suction is adjusted in accordance with rigidity of the printing target material P. A fourth characteristic thereof is a point that the suction through the suction holes 18 is made weak when ink is discharged onto the swelling portion of the printing target material P. However, all of the first to fourth characteristics need not be included and it is needless to say that only one of them may be included or any combinations thereof may be included alternatively.

Third Embodiment

Next, the third embodiment of the invention will be described. The placement table 17C according to the third embodiment of the invention as illustrated in FIG. 8 is configured such that a depth of the recess 19*c* (or recess 19*b*) can be adjusted. Reference numerals 20A, 20B, and 20C indicate spacers having different thicknesses. The spacers 20A, 20B, and 20C are put in the recess 19*c* (or the recess 19*b*) so that the depth thereof can be made appropriate in accordance with a swelling degree of a swelling portion of the printing target material P.

Through-holes 20*a* are formed in the spacers indicated by the reference numerals 20B and 20C. On the other hand, no through-hole 20*a* is formed in the spacer indicated by the reference numeral 20A. In this manner, if the through-hole 20*a* is selected to be provided or not to be provided, it can be easily selected for the printing target material P to be sucked or not to be sucked through the suction holes 18. If the printing target material P is sucked, strength of the suction can be adjusted. With the above configuration, the degree of freedom of the suction can be improved.

It is to be noted that the above method of adjusting the depth of the recess is merely an example and it is needless to say that the method is not limited thereto.

Another Configuration of Adjusting Depth of Recess

FIG. 10 illustrates another example of the configuration of adjusting the depth of the recess 19*c* (or recess 19*b*).

In this example, a portion of the placement table 17C, which corresponds to the recess 19*c* (or recess 19*b*), is configured to be movable in a suction direction. That is to say, the movable portion 17C' is movable in an up-down direction with respect to fixing portions 17C" of the placement table 17C and can be fixed by fixing tools 28 at an appropriate movement position. The structure of the fixing tools 28 is not limited to the L-shaped fixing tool as illustrated in FIG. 10 which can be detached and well-known fixing tools can be used.

Further, in this example, on the fixing portions 17C" of the placement table 17C, guiding portions 27 which guide movement of the movable portion 17C' are formed to be thicker than other portions. With this, guiding ranges of the guiding portions 27 are long so that movement of the movable portion 17C' is made stable.

The depth of the recess 19*c* (or recess 19*b*) can be made appropriate in accordance with the swelling degree of the swelling portion of the printing target material P with the configuration of the movable portion 17C'.

Fourth Embodiment

Next, the fourth embodiment of the invention will be described. On the placement table 17D according to the fourth embodiment of the invention as illustrated in FIG. 9, a holding members 21 which hold the printing target material P are provided on the periphery of the recess 19*c* (or recess 19*b*). In the embodiment, the holding member 21 is formed by a member (for example, rubber, cork, sponge or the like) realizing a high friction coefficient against the printing target material P. This makes it possible to prevent the swelling portion of the printing target material P from floating or lower the degree of the floating with the friction coefficient higher than that of a circumferential surface of the holding member 21 after the swelling portion has been made to fall in the recess 19*c* (or recess 19*b*).

When the holding member 21 is provided, it is preferable that the holding member 21 be provided so as not to form irregularities on the upper surface (placement surface) of the placement table 17D. For example, it is preferable that a recess be formed and then the holding member 21 be provided on the recess.

Fifth Embodiment

Next, the fifth embodiment of the invention is described with reference to FIGS. 11A and 11B. As illustrated in FIG. 11A, a printing target material P as a printing target in the embodiment is formed such that the neck portion M1 and sleeve stitching portions M3 instead of the pocket (FIG. 3) are thick. That is to say, the neck portion M1 and the sleeve stitching portions M3 correspond to swelling portions. A T-shirt (P) is formed such that the neck portion M1 and the sleeve stitching portions M3 are thick. Therefore, if the T-shirt is placed on a flat surface only, the neck portion M1 and the sleeve stitching portions M3 are made to swell to the upper side with respect to a surface (upper surface of the printing target material P) of the printing side. This arises a risk that the neck portion M1 and the sleeve stitching portions M3 rub with the ink jet head 23.

Then, as illustrated in FIG. 11B, the recess 19*c* having the shape corresponding to the neck portion M1 is formed on the placement table 17E of the embodiment at the position corresponding to the neck portion M1. In addition, recesses 19*d* having shapes corresponding to the sleeve stitching portions M3 are formed at positions corresponding to the sleeve stitching portions M3.

It is to be noted that the recess 19*c* and the recesses 19*d* are formed to be regions (areas) which are slightly larger than the neck portion M1 and the sleeve stitching portions M3, respectively.

In the embodiment, as illustrated in FIG. 11B, the recesses 19*c* and 19*d* are formed on the placement table 17E. Therefore, the neck portion M1 and the sleeve stitching portions M3 as the swelling portions fall in the recesses 19*c* and 19*d*, respectively. This makes it possible to set heights of the neck portion M1 and the sleeve stitching portions M3 to be substantially the same height as other printing regions. Accordingly, in the embodiment, a risk of rubbing with the head can be reduced. In addition, a distance between the ink jet head 23 and the printing target material P needs not be made larger in order to prevent the rubbing with the head from occurring, thereby obtaining a preferable printing result.

Sixth Embodiment

Next, the sixth embodiment of the invention is described with reference to FIGS. 12A and 12B. As illustrated in FIG. 12A, a printing target material P as a printing target of the embodiment is formed such that a neck collar portion M4, a button portion M5 and the sleeve stitching portions M3 are thick. That is to say, the neck collar portion M4, the button portion M5 and the sleeve stitching portions M3 correspond to swelling portions. The T-shirt (P) is formed such that the neck collar portion M4, the button portion M5 and the sleeve stitching portion M3 are thick. Therefore, if the T-shirt is placed on a flat surface only, the neck collar portion M4, the button portion M5 and the sleeve stitching portions M3 are made to swell to the upper side with respect to a surface (upper surface of the printing target material P) of the printing side. This arises a risk that the neck collar portion M4, the button portion M5 and the sleeve stitching portions M3 will rub with the ink jet head 23.

Then, as illustrated in FIG. 12B, a recess 19*e* having a shape corresponding to the neck collar portion M4 is formed on the placement table 17F of the embodiment at a position corresponding to the neck collar portion M4. Further, a recess 19*f* having a shape corresponding to the button portion M5 is formed at a position corresponding to the button portion M5. In addition, the recesses 19*d* having the shapes corresponding to the sleeve stitching portions M3 are formed at the positions corresponding to the sleeve stitching portions M3.

It is to be noted that the recesses 19*d*, 19*e*, and 19*f* are formed to be regions (areas) which are slightly larger than the sleeve stitching portions M3, the neck collar portion M4, and the button portion M5, respectively.

In the embodiment, as illustrated in FIG. 12B, the recesses 19*d*, 19*e*, and 19*f* are formed on the placement table 17F. Therefore, the sleeve stitching portions M3, the neck collar portion M4, and the button portion M5 as the swelling portions fall in the recesses 19*d*, 19*e*, and 19*f*, respectively. This makes it possible to set heights of the sleeve stitching portions M3, the neck collar portion M4, and the button portion M5 to be substantially the same height as other printing regions. Accordingly, in the embodiment, a risk of rubbing with the head can be reduced. In addition, a distance between the ink jet head 23 and the printing target material P needs not be made larger in order to prevent the rubbing with the head from occurring, thereby obtaining a preferable printing result.

Each of the above-described embodiments is merely an example and it is needless to say that the invention is not limited to the embodiments. Further, the invention is applied to the ink jet printing apparatus which discharges ink onto a printing target material such as a woven fabric. However, the invention can be also applied to an ink jet recording apparatus which performs recording on a recording target medium such as recording paper.

In addition, in each of the above-described embodiments, a configuration in which the placement tables 17A to 17F move in the y direction and the ink jet head 23 does not move in the y direction has been described. However, the invention is not limited thereto and it is sufficient that a configuration in which the relationship of the relative movement of them is satisfied is employed. Accordingly, a configuration in which the ink jet head 23 and the apparatus main body 2 are integrated with each other and move in the y direction, and the placement tables 17A to 17F do not move in the y direction may be employed instead of the above-described configuration. Alternatively, a configuration in which both of the placement tables 17A to 17F and the ink jet head 23 move in the y direction may be employed.

The entire disclosure of Japanese Patent Application No. 2011-191915, filed Sep. 2, 2011 and No. 2012-150683, filed Jul. 4, 2012 are expressly incorporated by reference herein.

What is claimed is:

1. An ink jet printing apparatus comprising:

a placement table on which a recess in which a swelling portion of a printing target material falls is formed and the printing target material is placed, the placement table including a friction member that is provided on a periphery of the recess; and a printing head that discharges ink onto a surface of the printing target material of a printing side placed on the placement table so as to execute desired printing.

2. The ink jet printing apparatus according to claim 1, wherein a suction hole through which the printing target material is sucked is provided in the recess.

3. The ink jet printing apparatus according to claim 2, further comprising:

a controller that is able to adjust a strength of suction through the suction hole.

4. The ink jet printing apparatus according to claim 3, wherein the controller is configured to adjust a degree of the suction through the suction hole based upon a rigidity of the printing target material.

5. The ink jet printing apparatus according to claim 3, wherein the controller is configured to adjust a degree of the suction through the suction hole based upon a location of ink discharged onto the printing target material, the suction being relatively weak when ink is discharged at least onto the swelling portion in comparison with cases other than this ink discharging.

6. The ink jet printing apparatus according to claim 1, further comprising:

a plurality of spacers of differing thickness configured to be disposed within the recess, the plurality of spacers adjusting a depth of the recess.

* * * * *